US008816919B2

(12) United States Patent
Kuramoto et al.

(10) Patent No.: US 8,816,919 B2
(45) Date of Patent: Aug. 26, 2014

(54) WIDE BAND ANTENNA, WEAR, AND PERSONAL BELONGINGS

(75) Inventors: Akio Kuramoto, Tokyo (JP); Yoshihide Takahashi, Tokyo (JP)

(73) Assignee: NEC Corporation, Tokyo (JP)

( * ) Notice: Subject to any disclaimer, the term of this patent is extended or adjusted under 35 U.S.C. 154(b) by 441 days.

(21) Appl. No.: 13/143,139

(22) PCT Filed: Jan. 14, 2010

(86) PCT No.: PCT/JP2010/050305
§ 371 (c)(1),
(2), (4) Date: Jul. 1, 2011

(87) PCT Pub. No.: WO2010/082591
PCT Pub. Date: Jul. 22, 2010

(65) Prior Publication Data

US 2011/0273345 A1 Nov. 10, 2011

(30) Foreign Application Priority Data

Jan. 14, 2009 (JP) ..... 2009-005641

(51) Int. Cl.
*H01Q 1/12* (2006.01)

(52) U.S. Cl.
USPC ..... 343/718

(58) Field of Classification Search
USPC ..... 343/700 MS, 702, 718, 860
See application file for complete search history.

(56) References Cited

U.S. PATENT DOCUMENTS

| | | | | |
|---|---|---|---|---|
| 4,843,403 | A * | 6/1989 | Lalezari et al. | 343/767 |
| 6,914,562 | B2 * | 7/2005 | Forster | 343/700 MS |
| 7,327,318 | B2 * | 2/2008 | Frank et al. | 343/700 MS |
| D609,700 | S * | 2/2010 | Takahashi | D14/230 |
| 7,948,445 | B2 * | 5/2011 | Kuramoto | 343/860 |
| 2005/0088344 | A1 * | 4/2005 | Saitou et al. | 343/700 MS |

FOREIGN PATENT DOCUMENTS

| | | | |
|---|---|---|---|
| JP | 2007110693 | A | 4/2007 |
| JP | 2007324841 | A | 12/2007 |
| JP | 2008278150 | A | 11/2008 |

OTHER PUBLICATIONS

International Search Report for PCT/JP2010/050305 mailed Apr. 27, 2010.

M Tanaka et al., "Wearable Patch Antenna", Technical Report of IEICE, AP2002-76, 2002, pp. 77-80.

* cited by examiner

*Primary Examiner* — Seung Lee
(74) *Attorney, Agent, or Firm* — Sughrue Mion, PLLC

(57) ABSTRACT

A first plate-like radiating element including a first side and a second side, the first side being a straight line portion and the second side being curved; and a second plate-like radiating element including a third side and a fourth side, the third side being a straight line portion and the fourth side being curved, are included. The first side of the first radiating element and the third side of the second radiating element are disposed to face each other in parallel and to be shifted in a parallel direction. The second side and the fourth side each preferably include a curve portion. The second side or the fourth side or the second and fourth sides is (are) preferably formed by a combination of one or a plurality of curve portions and one or a plurality of straight line portions.

20 Claims, 14 Drawing Sheets

WIDE BAND ANTENNA, WEAR, AND PERSONAL BELONGINGS

This application is the National Phase of PCT/JP2010/050305, filed Jan. 14, 2010, which claims priority to Japanese Patent Application No. 2009-005641 filed on Jan. 14, 2009. All contents disclosed in Japanese Patent Application No. 2009-005641 are incorporated herein by reference.

TECHNICAL FIELD

The present invention relates to a wideband antenna, wear, and a belonging, and more particularly to a wideband antenna including two plate-like radiating elements, and wear and a belonging using the wideband antenna.

BACKGROUND ART

In recent years, various outdoor radio service systems have been able to be used, such as cellular phones, wireless LAN hotspot services, and WiMAX. In addition, in a broadcasting field, too, digital terrestrial television broadcasting has started. To effectively utilize a variety of such wireless services, it is important to improve antenna performance.

Meanwhile, terminals supporting the above-described plurality of services require wideband antennas. With the advance of miniaturization of terminals used for the above-described services, the sensitivity of antennas included in the terminals decreases.

An antenna that solves the aforementioned problems requires the following points:

(1) The antenna can support a variety of different bands, and secures a 25% or more frequency band in those bands or has wideband characteristics.

(2) The antenna is a wearable antenna that can be attached to clothing or a body. Even if the antenna is added to clothing, etc., the input impedance matching characteristics do not deteriorate and wideband characteristics can be obtained.

An antenna having the performance described in the above point (1) can use a plurality of services in a shared manner. An antenna having the performance described in the above point (2) is put on clothing and can thereby serve as a large antenna without becoming an obstacle. By allowing the antenna to serve as a large antenna, a sufficient received electric field or an antenna gain for communication can be obtained.

For a wideband antenna, there is a discone antenna such as that shown in FIG. 1. The antenna has wideband characteristics but has a three-dimensional configuration in which a disc 801 of a conductor and a cone 802 of a conductor are combined. A center coaxial conductor 804 of a coaxial cable 803 is connected to the disc 801, and an outer coaxial conductor 805 is connected to the cone 802.

For an antenna formed of a conductive fabric and mountable near a human body, there is a patch antenna made of a fabric such as that shown in FIG. 2. This antenna is disclosed in Non-Patent Literature 1. The patch antenna is formed of a patch 901 made of a conductive fabric; a ground 902, and an insulation fabric 903 serving as an insulator.

In addition, Patent Literature 1 describes a wideband antenna in which two radiating elements of a substantially right triangle shape are combined such that they are shifted from each other parallelly.

CITATION LIST

Patent Literature

{PTL 1} JP-A-2008-278150

Non-Patent Literature

{NPTL 1} Papers from IEICE Technical Committee on Antennas and Radio Wave Propagation (IEICE Technical Report AP2002-76)

SUMMARY OF THE INVENTION

Technical Problem

The wideband antenna shown in FIG. 1 has a complex configuration where the coaxial cable 803 enters the cone 802 from the bottom and is connected to a central portion for feeding. Furthermore, it is difficult to form this configuration using a conductive fabric and also there is no case found describing that excellent matching characteristics are exhibited when the antenna is placed near a human body.

Also, there is no precedent found for a feed method in which soldering is not directly used.

The antenna shown in FIG. 2 is formed of a fabric and thus is freely bendable and can be put on clothing. However, only very narrow band characteristics can be obtained.

There is a demand for a wideband antenna having wider band characteristics than those obtained by a wideband antenna of the configuration disclosed in Patent Literature 1.

Solution to Problem

According to a first exemplary aspect of the present invention, there is provided a wideband antenna including: a first plate-like radiating element including at least a first side and a second side, the first side being a straight line portion and the second side being curved; and a second plate-like radiating element including at least a third side and a fourth side, the third side being a straight line portion and the fourth side being curved, wherein the first side of the first radiating element and the third side of the second radiating element are disposed to face each other in parallel and to be shifted from each other in a parallel direction.

Advantage Effects of Invention

According to the exemplary wideband antenna of the present invention, a planar, wideband, and dual band antenna can be obtained.

DESCRIPTION OF EMBODIMENT

An exemplary embodiment of the present invention will be described in detail below using the drawings. Note that a wideband antenna described below is an antenna that radiates (transmits) a signal current into space as a radio wave (electromagnetic wave), or conversely, converts (receives) a radio wave (electromagnetic wave) in space into a signal current, and one component of the antenna is called a radiating element. However, the radiating element can, of course, perform reception. The radiating element is also called an antenna element.

A configuration of one embodiment of a wideband antenna according to the present invention will be described below, comparing with a configuration of Patent Literature 1.

Figure 1:
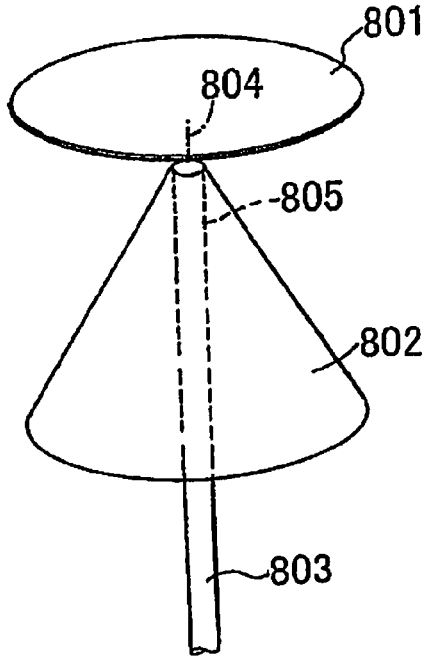
FIG. 1 PRIOR ART
FIG. 1 A diagram shows a configuration of an antenna which is an example of the background art.
Figure 2:
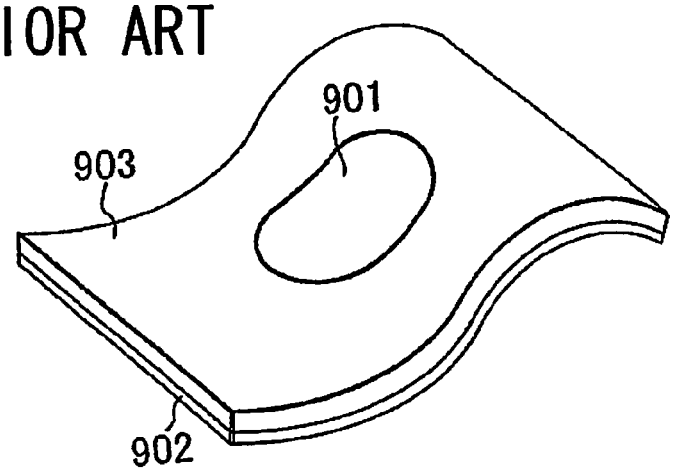
FIG. 2 PRIOR ART
FIG. 2 A diagram shows a configuration of an antenna which is another example of the background art.
Figure 3:
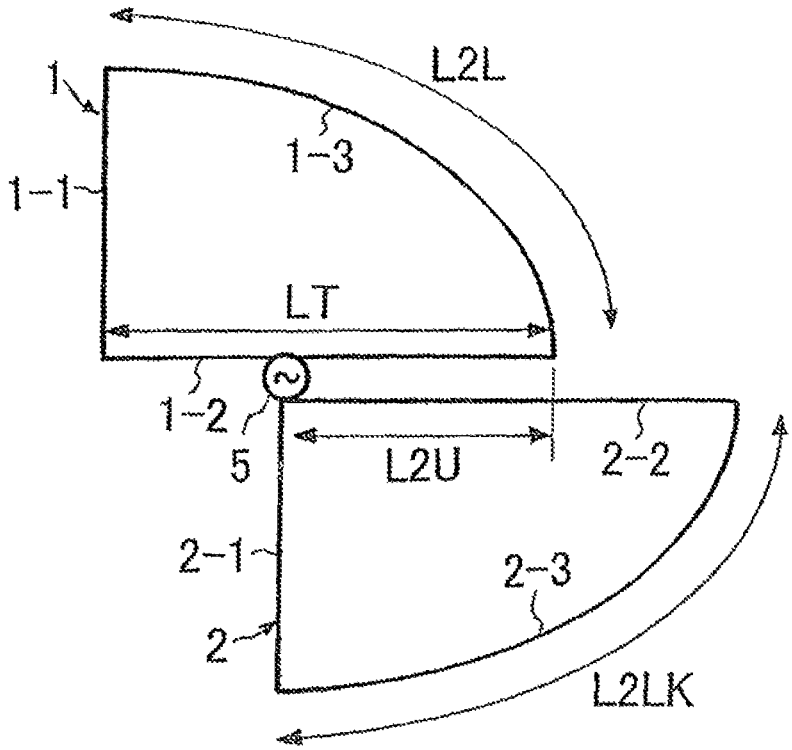
FIG. 3 A configuration diagram shows a configuration of one embodiment of a wideband antenna according to the present invention.
Figure 4:
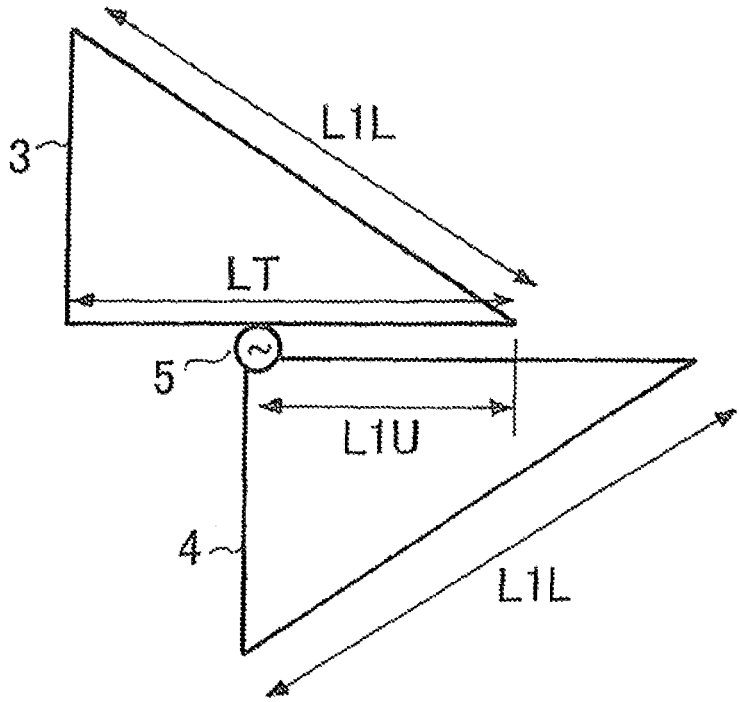
FIG. 4 A configuration diagram shows a configuration of a wideband antenna disclosed in Patent Literature 1.

(1) FIG. 3 is a configuration diagram showing a configuration of one embodiment of a wideband antenna according to the present invention. FIG. 4 is a configuration diagram showing a configuration of a wideband antenna disclosed in Patent Literature 1.

As shown in FIG. 3, the wideband antenna of the present embodiment includes a plate-like radiating element 1 and a plate-like radiating element 2. The radiating element 1 is surrounded by a side made up of a straight line portion 1-1, a side made up of a straight line portion 1-2 (which serves as a first side), and a side made up of a curve portion 1-3 (which serves as a second side). The radiating element 2 is surrounded by a side made up of a straight line portion 2-1, a side made up of a straight line portion 2-2 (which serves as a third side), and a side made up of a curve portion 2-3 (which serves as a fourth side). The curve portions 1-3 and 2-3 respectively form the second side and the fourth side which are curved. As used herein, the term "curved" refers to that a side is bent to bulge outwardly of the element.

On the other hand, FIG. 4 shows a configuration of one embodiment disclosed in Patent Literature 1, and first and second radiating elements 3 and 4 have triangle structures. In FIG. 4, a length L1U is the length from a feed portion 5 to an end of a region where the radiating element 3 and the radiating element 4 face each other, and a length L1L is the length of a hypotenuse of the radiating element 3 or the radiating element 4. Note that the feed portion 5 shown in FIG. 4 schematically shows a feed position between the radiating element 3 and the radiating element 4, and examples of an actual feed method are shown in FIGS. 10, 11, 12, and 13. As shown in FIG. 14, radiating elements may be fed by a microstrip transmission line.

In the configuration in FIG. 4, the upper frequency limit and lower frequency limit of band characteristics are determined by the length L1U and the length L1L. Specifically, the upper frequency limit is a frequency at which the length L1U is a quarter wavelength, and the lower frequency limit is a frequency at which the length L1L is a quarter wavelength. The fact that the length is determined by a quarter wavelength is based on the same operating principles as those of notch antennas and monopole antennas. Considering the radiating element 4 which is a lower element in FIG. 4 as the ground, the hypotenuse of the radiating element 3 which is an upper element, i.e., the length L1L, resonates at a quarter wavelength portion. This is the same principle as that of monopole antennas, and by this length the lower frequency limit is determined. In addition, a notch with the length L1U is formed between the radiating element 3 and the radiating element 4, and a frequency at which the length of this notch portion resonates at a quarter wavelength is the upper frequency limit.

On the other hand, as in the present embodiment, by making the hypotenuses to be curves, wider band characteristics can be obtained. The upper frequency limit and the lower frequency limit in this case are determined, as in FIG. 4, by a length L2U and a length L2L in FIG. 3. Specifically, the upper frequency limit is a frequency at which the length L2U is a quarter wavelength, and the lower frequency limit is a frequency at which the length L2L is a quarter wavelength.

In the configuration of the present embodiment shown in FIG. 3, those sides corresponding to the hypotenuses in FIG. 4 are curves. Thus, if a base of the radiating element 3 and a base of the radiating element 1 have the same length (length LT), then the length L2L is longer than the length L1L, enabling to cover low frequencies. That is, as in FIG. 3, by making the hypotenuses to be curves to increase the length, wider band characteristics than those obtained by the triangle structures in FIG. 3 can be obtained.

Note that in the above description, in order to widen bandwidth, it is considered to reduce the length of the notch with the length L1U between the radiating element 3 and the radiating element 4; however, if the length L1U is changed, then the input impedance of the antenna itself also changes. Therefore, in practice, the length L1U is determined by a balance between the input impedance and the upper frequency limit and thus does not have much flexibility.

(2) Even if the radiating element 1 and the radiating element 2 have the same shape, the above-described action and effect can be achieved by making the hypotenuses to be curves. However, by making the shapes of the radiating element 1 and the radiating element 2 asymmetric, further widening of bandwidth can be achieved.

As described above, the lower frequency limits of the radiating elements 3 and 1 which are the upper elements of the antennas in FIGS. 4 and 3 are determined by the length L1L and the length L2L. This is because at a quarter wavelength of the lower frequency limit, resonance occurs at the hypotenuse with the length L1L or the curve portion with the length L2L.

At this time, currents are also distributed to the hypotenuses of the radiating elements 4 and 2 which are the lower elements, and resonance occurs at frequencies at which the hypotenuses of the radiating elements 4 and 2 are a quarter wavelength. In the case of the configuration in FIG. 4, since the hypotenuse of the radiating element 3 and the hypotenuse of the radiating element 4 have the same length L1L, the lower frequency limit is determined by one resonance.

In the case of FIG. 3, however, since the structure is upper and lower asymmetric and the length L2L of the hypotenuse (curve portion) of the radiating element 1 is made different from a length L2LK of the hypotenuse (curve portion) of the radiating element 2, frequencies at which resonance occurs are also different. There is no particular limitation on the difference between the length L2L and the length L2LK, but the difference is preferably roughly on the order of ±10% or less. In this case, resonance occurs at two frequencies at which the length L2L and the length L2LK are a quarter wavelength. Since the two frequencies are adjacent to each other, the radiating elements act like stagger tuning, enabling to design to provide double-humped or broad resonance characteristics. As such, by allowing the length L2L and the length L2LK to have values different from each other by the order of 5% to 10%, without the impedance characteristics deteriorating suddenly in the neighborhood of the lower frequency limit, the bandwidth increases in a lower frequency limit direction in the neighborhood of the lower frequency limit.

As described above, when the lengths LT are the same in FIGS. 3 and 4, by making the length L1L<length L2L<length L2LK, although the lower frequency limit is roughly determined by the length L2L, due to the stagger tuning effect brought about with the hypotenuse with the length L2LK, the lower bandwidth limit is further extended.

Note that in FIGS. 3 and 4 the lengths may be such that the length L1L<length L2LK<length L2L.

Figure 5:
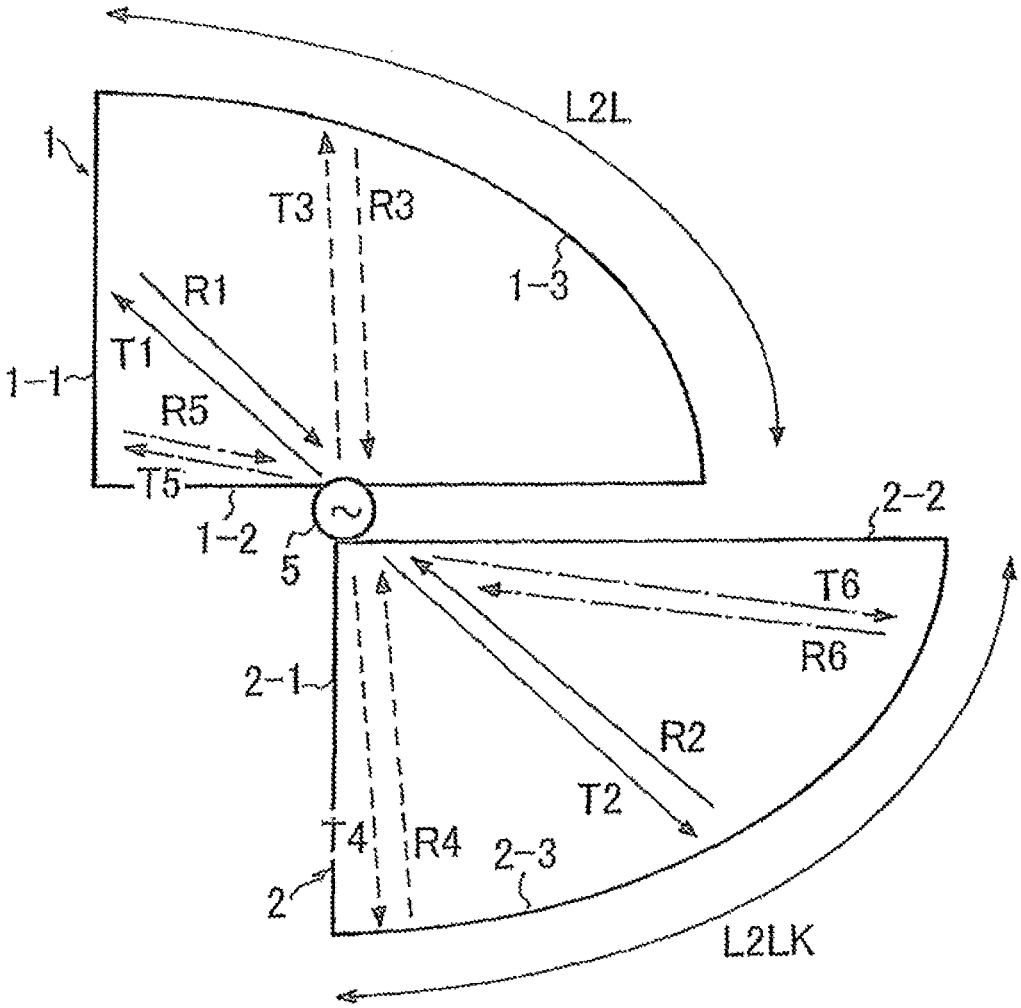
FIG. 5 A diagram shows power paths in the one embodiment of the wideband antenna according to the present invention.

(3) In FIG. 3, the positions of the radiating element 1 which is the upper element and the radiating element 2 which is the lower element are shifted in a horizontal direction to place a feed portion 5 approximately at a left edge of the radiating element 2 or in the vicinity of the left edge, thereby making the disposition of the radiating elements 1 and 2 asymmetric. By such a configuration, even if the antenna is placed near a matter with a high dielectric constant such as a human body, the antenna can be used without deteriorating the input impedance characteristics.

i) First, the point that reflection as viewed from the feed portion 5 can be suppressed by shifting the positions of the radiating element 1 and the radiating element 2 in the horizontal direction will be described. Specifically, as shown in FIG. 5, high-frequency power input from the feed portion 5 radially flows into the radiating element 1 and the radiating element 2. At this time, when there is a factor near the antenna that inhibits the radiation of radio waves and deteriorates the input impedance, such as a dielectric, a part of the power is reflected and returns. In FIG. 5, input powers T1, T3, and T5 are input powers to the radiating element 1, and input powers T2, T4, and T6 are input powers to the radiating element 2 which correspond to the input powers T1, T3, and T5. Reflected powers R1, R3, and R5 are reflected powers from an edge of the radiating element 1, and reflected powers R2, R4, and R6 are reflected powers from an edge of the radiating element 2 which correspond to the reflected powers R1, R3, and R5.

In this case, since the radiating element 1 and the radiating element 2 are shifted parallelly, the distance to the edge of the radiating element 1 as viewed radially from the feed portion 5 differs from the distance to the edge of the radiating element 2. Specifically, a path of power on which the input power T1 is reflected and returns as the reflected power R1 differs from a path of power on which the input power T2 corresponding to the input power T1 is reflected and returns as the reflected power R2. Namely, the paths of these two corresponding reflected powers differing from each other indicates that the phases differ from each other. Thus, when viewed from the feed portion 5, the reflected powers are not added with the same phase but are, in fact, cancelled out.

Likewise, a path of power on which the input power T3 is reflected and returns as the reflected power R3 differs from a path of power on which the input power T4 corresponding to the input power T3 is reflected and returns as the reflected power R4. Also, a path of power on which the input power T5 is reflected and returns as the reflected power R5 differs from a path of power on which the input power T6 corresponding to the input power T5 is reflected and returns as the reflected power R6. Namely, since the paths of two corresponding reflected powers differ from each other and thus the phases differ from each other, the reflected powers are cancelled out, as viewed from the feed portion 5.

By the above-described principle, by shifting the positions of the radiating element 1 and the radiating element 2 in the horizontal direction, even if the antenna is placed near a matter with a high dielectric constant such as a human body, the antenna can achieve performance with no deterioration in input impedance characteristics.

ii) Next, an effect brought about by placing the feed portion 5 approximately at a left edge of the radiating element 2 or in the vicinity of the left edge will be described. This effect is related to the content in the above-described i). Specifically, in the paths of reflected powers in the above-described i), the greater the difference in reflection path between the radiating element 1 and the radiating element 2, the greater the amount of reflected powers of the radiating element 1 and the radiating element 2 cancelled out. To do so, in the configuration in FIG. 5, disposing the feed portion 5 at the left edge of the radiating element 2 is a method that can make the biggest difference in path, i.e., phase. Thus, placing the feed portion 5 approximately at the left edge of the radiating element 2 minimizes reflection and thereby maintains excellent input impedance matching characteristics.

When the position of the feed portion 5 is changed from the left edge to the center, the distance from the feed portion 5 to a left edge of the radiating element 1 becomes close to the distance from the feed portion 5 to a right edge of the radiating element 2, i.e., the difference is reduced between the distance of a path on which the input power T5 from the feed portion 5 returns as the reflected power R5 and the distance of a path on which the input power T6 from the feed portion 5 returns as the reflected power R6. Accordingly, the reflected powers are close to combining with the same phase at the feed portion 5. Therefore, reflection as viewed from the feed portion 5 increases, resulting in poor input impedance matching characteristics.

iii) A combination effect bought about by making the shapes of the radiating element 1 and the radiating element 2 asymmetric will be described.

In the power paths in FIG. 5, it is relatively difficult to make a path difference between a path on which the input power T3 returns as the reflected power R3 and a path on which the input power T4 returns as the reflected power R4. In such a case, by making the shapes of the radiating element 1 and the radiating element 2 asymmetric, an adjustment can be made to make a big difference between the path on which the input power T3 returns as the reflected power R3 and the path on which the input power T4 returns as the reflected power R4.

The greater the difference in reflection path between the radiating element 1 and the radiating element 2, the greater the amount of reflected powers of the radiating element 1 and the radiating element 2 cancelled out. Therefore, by making the curves of the hypotenuses to be different curves so as to make the biggest possible path difference between the path on which the input power T3 returns as the reflected power R3 and the path on which the input power T4 returns as the reflected power R4, i.e., the biggest possible phase difference, the reflected powers as viewed from the feed portion 5 are not added with the same phase but are, in fact, more easily cancelled out.

Note that in the above description the second curved side of the radiating element 1 (the side made up of the curve portion 1-3) and the fourth curved side of the radiating element 2 (the side made up of the curve portion 2-3) each are formed only by a single curve portion, but may be formed by a plurality of curve portions with different radii of curvature or by a curve portion and a straight line portion. In addition to a curve, any number of curves, a curve and a straight line, and a combination of any number of curves and any number of straight lines, a combination of any number of straight lines is also effective. Note, however, that in any of those cases, in accordance with the above-described principle, the second side and the fourth side are formed to bulge more outwardly of the triangles than the hypotenuses with the length L1L in FIG. 4 which is the conventional example. Therefore, when the second side and the fourth side each are formed by a combination of any number of straight lines, the angle formed by arbitrary sides is, as viewed from the inside of the element, an obtuse angle. Note, however, that the angle formed by the first side (the side made up of the straight line portion 1-2) and the third side (the side made up of the straight line portion 2-2) is an acute angle. The fact that in the above-description, in the case of forming a side by a combination of any number of straight lines, the closer the any number is to infinity the closer the side is to a curve is easily understood.

Furthermore, in the above-description, the second side and the fourth side are formed to bulge more outwardly of the triangles than the hypotenuses with the length L1L in FIG. 4 which is the conventional example. For the degree of the bulging, a value roughly greater than or equal to a 0.1 wavelength of the lowest useful frequency is used in a perpendicular direction of the centers of the second side and the fourth side with respect to the hypotenuses in FIG. 4. Note that in a configuration in FIG. 5C of Patent Literature 1, the vertices of radiating elements are cut off; in this case, sides are formed to bulge a value greater than or equal to a 0.1 wavelength of the lowest useful frequency, with respect to hypotenuses in FIG. 5C.

The radiating elements 1 and 2 can be formed of a freely bendable Flexible Printed Circuit (FPC) whose surface has conductivity, conductive fabrics, etc. The radiating elements 1 and 2 can be then attached to clothing, etc., with magic tapes (registered trademark), buttons, etc., and can thereby form a wideband antenna. When the radiating elements 1 and 2 are formed of conductive fabrics, etc., which are difficult to solder, a coaxial cable is soldered to a small-size, freely bendable Flexible Printed Circuit (FPC) and the flexible printed circuit is sewed on the conductive fabrics. By this, an antenna having capacitance and performing equivalent feeding can be formed.

In addition, the radiating elements 1 and 2 can be formed by etching a metal plate, a conductive plate, or a printed circuit board.

The shapes of the radiating elements 1 and 2 are not particularly limited to those in the configuration of FIG. 3. Specifically, the shapes of the radiating elements 1 and 2 can be appropriately changed as long as the radiating element 1 has at least a first side which is a straight line portion and a second side which is a curve portion, and the radiating element 2 has at least a third side which is a straight line portion and a fourth side which is a curve portion, and as an antenna configuration, the first side and the third side face each other in parallel and can be disposed so as to be shifted in a parallel direction. For example, configurations such as those described in first to fourth examples which will be described later may be adopted.

First Example

Figure 6:
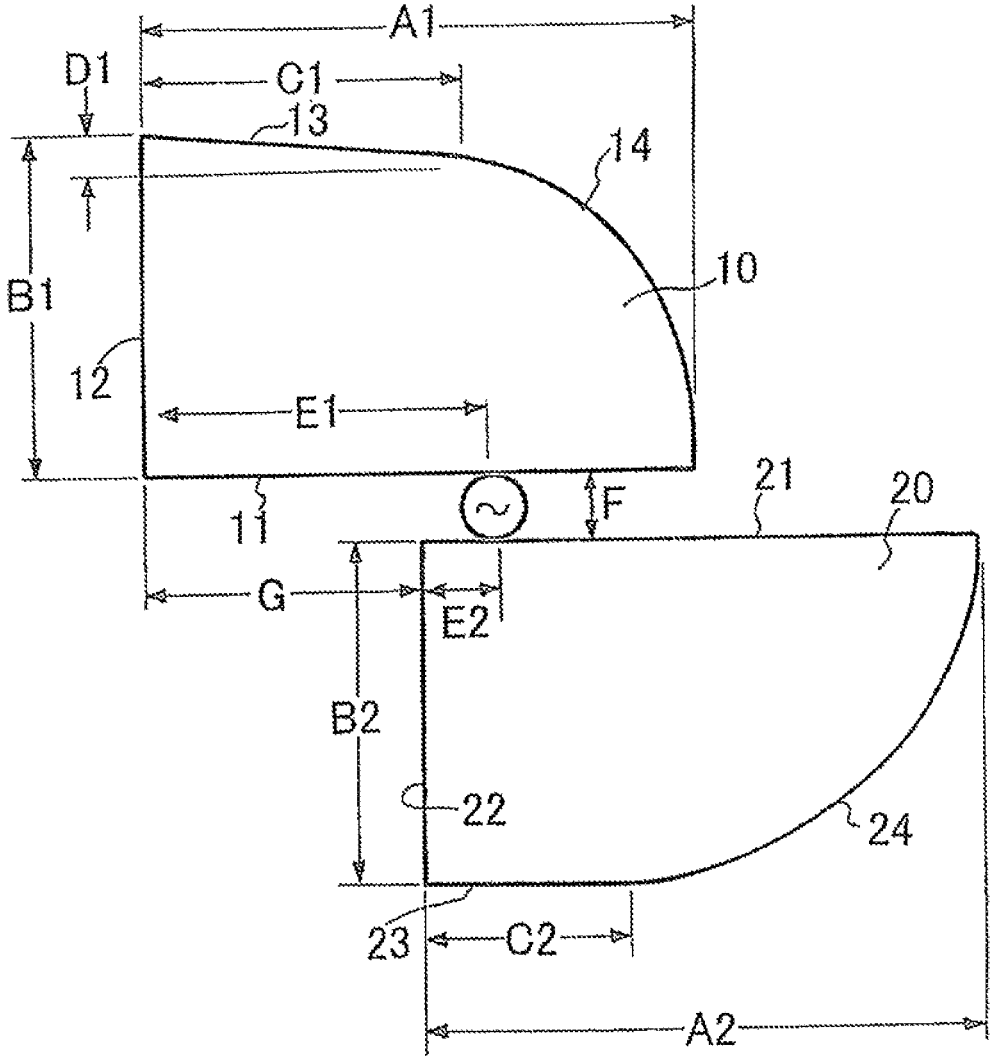
FIG. 6 A configuration diagram shows a first example of a wideband antenna according to the present invention.

FIG. 6 is a configuration diagram of a first example of a wideband antenna according to the present invention. The wideband antenna of the present example includes a radiating element 10 and a radiating element 20.

The radiating element 10 is made of a plate-like conductor surrounded by a side which is a straight line portion 11 with a length A1 (which serves as a first side), a side which is a straight line portion 12 with a length B1, and a side made up of a straight line portion 13 and an arc-shaped curve portion 14 (which serves as a second side which is curved). The side which is the straight line portion 12 serves as a fifth side connecting to the side which is the straight line portion 11 (first side). In the present example, the side which is the straight line portion 12 is disposed at substantially right angles to the side which is the straight line portion 11.

A length C1 is the length, in a vector component direction parallel to the straight line portion 11, of the straight line portion 13 and a length D1 is the length, in a vector component direction parallel to the straight line portion 12, of the straight line portion 12. The number of straight line portions and the number of curve portions are set arbitrarily. For example, a part of the curve portion 14 may be formed by a straight line portion or, as in the configuration in FIG. 3, a side other than two sides, the straight line portions 11 and 12, may be formed only by a curve portion.

The radiating element 20 is made of a plate-like conductor surrounded by a side which is a straight line portion 21 with a length A2 (which serves as a third side), a side which is a straight line portion 22 with a length B2, and a side made up of a straight line portion 23 and an arc-shaped curve portion 24 (which serves as a fourth side which is curved). The side which is the straight line portion 22 serves as a sixth side connecting to the side which is the straight line portion 21 (third side). In the present example, the side which is the straight line portion 22 is disposed at substantially right angles to the side which is the straight line portion 12. The straight line portion 23 is parallel to the straight line portion 21, and the length of the straight line portion 23 is a length C2. The number of straight line portions and the number of curve portions are set arbitrarily. For example, a part of the curve portion 24 may be formed by a straight line portion or, as in the configuration in FIG. 3, a side other than two sides, the straight line portions 21 and 22, may be formed only by a curve portion.

The side which is the straight line portion 11 and the side which is the straight line portion 21 are disposed facing each other and substantially in parallel with each other, and feeding is performed at desired positions on the sides facing each other. In the present embodiment, a feed portion is placed in the vicinity of a left edge of the radiating element (in the vicinity of the straight line portion 22).

A spacing F is a spacing between the straight line portion 11 and the straight line portion 21, a length G is a length between the straight line portion 12 and the straight line portion 22, a length E1 is a length between the straight line portion 12 and the feed point, and a length E2 is a length between the straight line portion 22 and the feed point.

In the present example, the shapes of the radiating element 10 and the radiating element 20 are asymmetric and are not identical. In particular, by changing the shapes of a combination of the straight line portion 13 and the curve portion 14 and a combination of the straight line portion 23 and the curve portion 24, different radiating element shapes are implemented. Specifically, different element shapes are implemented by changing the lengths and inclinations of the straight line portion 13 and the straight line portion 23 and allowing the radii of curvature of the curve portion 14 and the curve portion 24 to have different values. The shapes may be changed by either changing the lengths and inclinations of the straight line portion 13 and the straight line portion 23 or allowing the radii of curvature of the curve portion 14 and the curve portion 24 to have different values. Note that the curve portions 14 and 24 include various curves such as an elliptic curve, a parabola, and a hyperbola.

Different radiating element shapes can also be implemented by allowing the lengths of the straight line portion 11 and the straight line portion 21 which correspond to each other in the radiating element 10 and the radiating element 20 to have different values between the radiating element 10 and the radiating element 20.

In FIG. 6, the lengths A1 and A2 of the side which is the straight line portion 11 and the side which is the straight line portion 21 of the radiating elements 10 and 20 are preferably selected to be about a 0.25 wavelength (quarter wavelength) of the lower frequency limit used in a high frequency band. The reason for such is that, although it has been described that the actual lower frequency limit is a frequency at which the length of a hypotenuse is a 0.25 wavelength, normally, to make allowance, the lengths A1 and A2 are set to the order of a 0.25 wavelength, whereby the hypotenuses are longer than that, enabling to cover the lower frequency limit with allowance. Whether to select a value for the lengths A1 and A2 with allowance is a design requirement. The lengths B1 and B2 of the side which is the straight line portion 12 and the side which is the straight line portion 22 of the radiating elements 10 and 20 are preferably selected to be about a 0.17 wavelength of the lower frequency limit used in the high frequency band.

The radiating elements 10 and 20 are disposed such that the side which is the straight line portion 11 and the side which is the straight line portion 21 are shifted in a parallel direction (parallel movement). The amount of shift (the length between the straight line portion 12 and the straight line portion 22) G is more preferably in the neighborhood of a 0.14 wavelength of the lower frequency limit used, but depending on the matching state, the amount of shift G is preferably selected to be between 0.1 to 0.2 wavelengths. The length E2 can be selected to be on the order of a 0 to 0.1 wavelength of the lower frequency limit in the high frequency band. The spacing between the straight line portion 11 and the straight line portion 21 (the distance between the radiating element 10 and the radiating element 30) F is preferably selected to be between 0.001 to 0.03 wavelengths of the lower frequency limit.

Feeding is performed by connecting a feeder such as a parallel two-wire transmission line or a coaxial cable. At this time, the spacing F between the two radiating elements at the feed portion is preferably selected to be between 0.001 to 0.03 wavelengths of the lower frequency limit in the high frequency band.

Second Example

Figure 7:
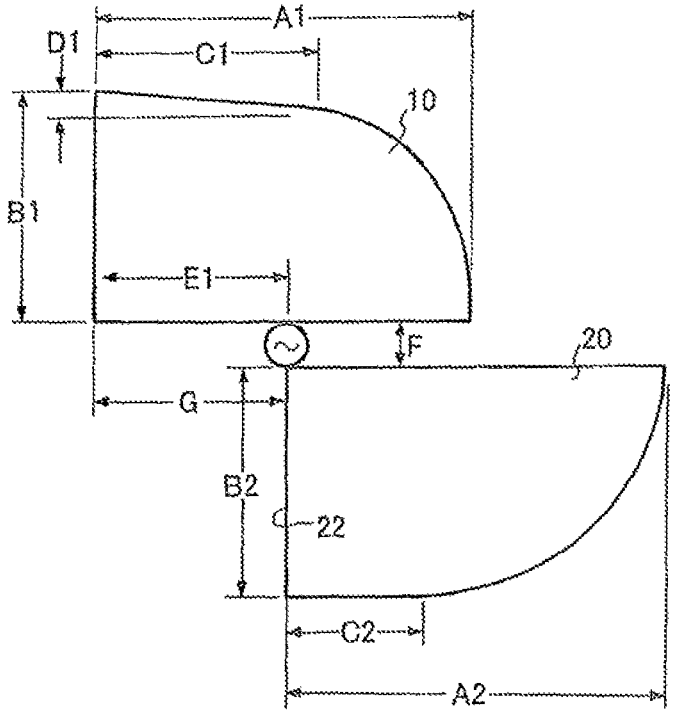
FIG. 7 A configuration diagram shows a second example of a wideband antenna according to the present invention.

FIG. 7 is a configuration diagram of a second example of a wideband antenna according to the present invention. The difference in configuration from that of the first example shown in FIG. 6 is that a feeding location is present on a line extending from a straight line portion 22. As already described using FIG. 5, placing a feed portion approximately at a left edge of a lower element further reduces reflection, enabling to maintain excellent input impedance matching characteristics.

Third Example

Figure 8:
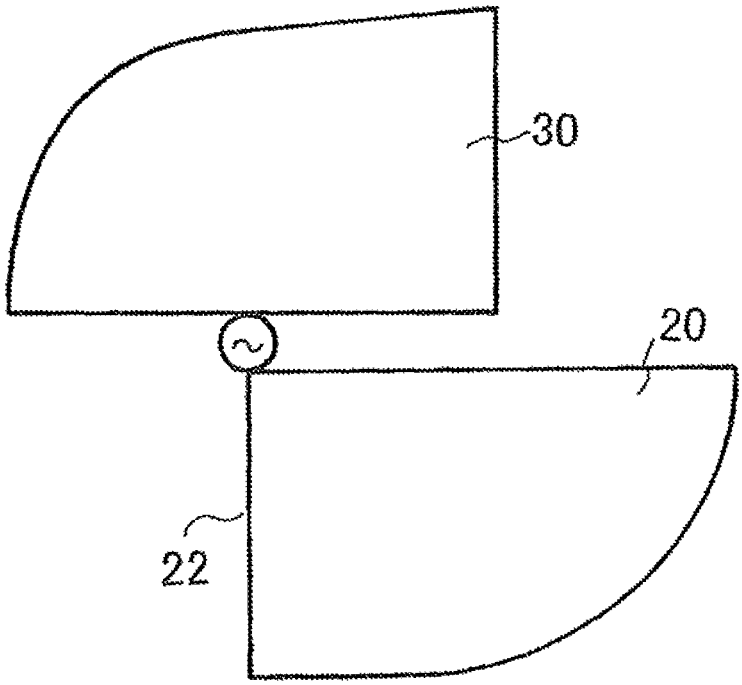
FIG. 8 A configuration diagram shows a third example of a wideband antenna according to the present invention.

FIG. 8 is a configuration diagram of a third example of a wideband antenna according to the present invention. The difference from the second example shown in FIG. 7 is that a radiating element 30 has such a shape that the radiating element 30 is inverted in a left-right direction of a radiating element 10. Specifically, the radiating element 30 is formed by inverting the radiating element 10 in FIG. 7 with respect to a straight line portion 22 of a radiating element. There is no big electrical difference between the configuration of the present example and the configuration in FIG. 7. Namely, as for a high frequency band, since the radiating element 30 is only left-right inverted, there is no change in terms of impedance matching and wideband properties.

Fourth Example

Figure 9:
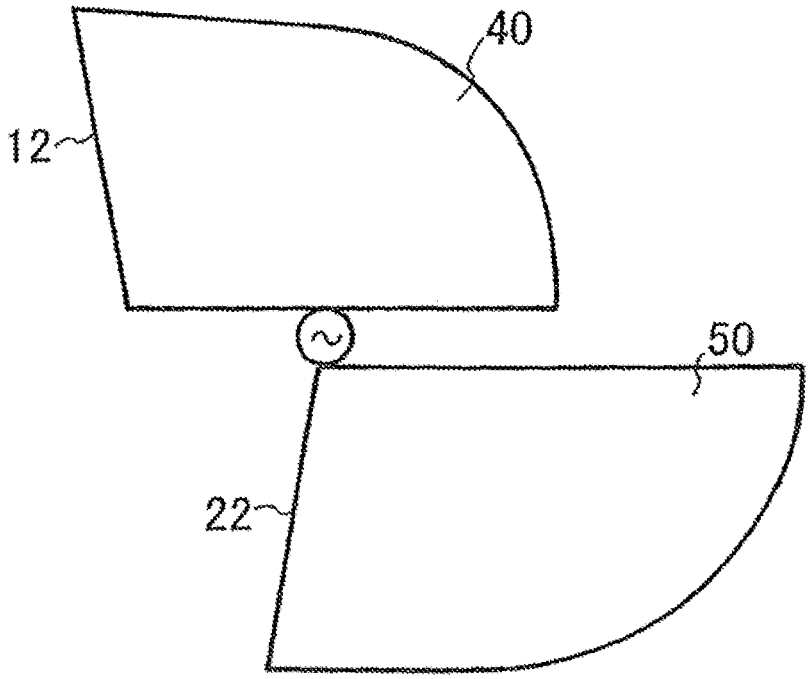
FIG. 9 A configuration diagram shows a fourth example of a wideband antenna according to the present invention.

FIG. 9 is a configuration diagram of a fourth example of a wideband antenna according to the present invention. The difference from the second example shown in FIG. 7 is that radiating elements 40 and 50 are formed such that straight line portions 12 and 22 are inclined. The straight line portion 12 forms an obtuse angle (greater than 90 degrees but less than 180 degrees) with a bottom side (first side) of the radiating element 40, and the straight line portion 22 forms an obtuse angle (greater than 90 degrees but less than 180 degrees) with a top side (third side) of the radiating element 50.

By thus inclining the straight line portions 12 and 22, a minute adjustment to the lower frequency limit can be made. The lower frequency limit of the antenna shown in FIG. 3 is determined by the length L2L or the length L2LK. On the other hand, the input impedance matching characteristics and the upper frequency limit of the antenna in FIG. 3 are determined by the length L2U. In the present embodiment, as shown in FIG. 9, without changing the length L2U, by inclining the straight line portions 12 and 22 to minutely adjust the lower frequency limit, the length L2L and the length L2LK can be changed. Thus, the lower frequency limit can be adjusted.

Note that there is also a method in which the heights of the radiating element 40 and the radiating element 50 are changed; however, in view of the fact that the length L2L and the length L2LK can be more easily changed by the inclining method and that changing the heights changes the input impedance characteristics (because changing a height direction changes the lengths of paths of reflected powers), inclining the straight line portions 12 and 22 has the advantage of the capability to easily adjust the lower frequency limit without changing the impedance matching characteristics.

Fifth Example

Figure 10:
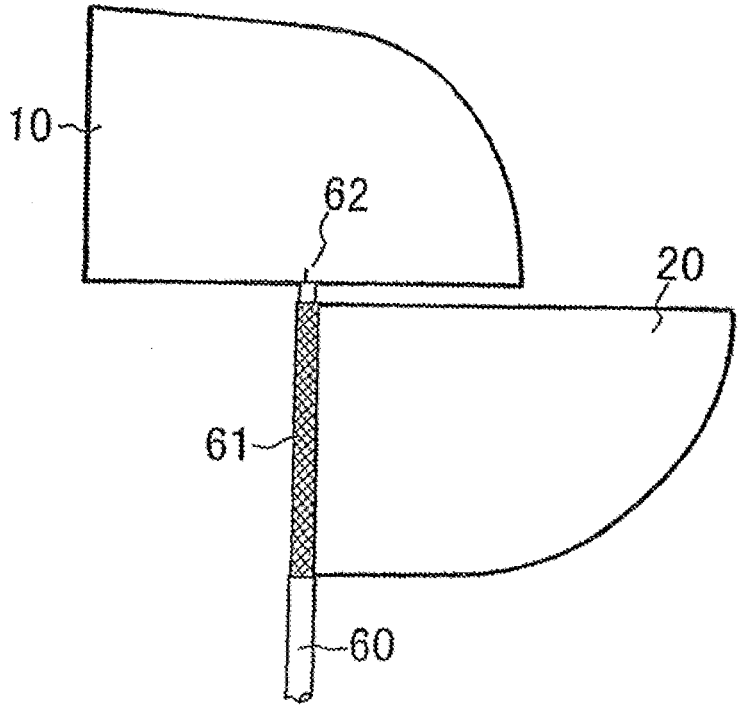
FIG. 10 A configuration diagram shows a fifth example of a wideband antenna according to the present invention.

FIG. 10 is a configuration diagram of a fifth example of a wideband antenna according to the present invention. The present example is an example of the case of using a coaxial cable for feeding in the configuration of FIG. 7. A center coaxial conductor 62 of a coaxial cable 60 is connected to a radiating element 10, and an outer coaxial conductor 61 is connected to a radiating element 20. The connection between the center coaxial conductor 62 and the radiating element 10 and the connection between the outer coaxial conductor 61 and the radiating element 20 use, for example, soldering, crimping, or a conductive adhesive.

Figure 11:
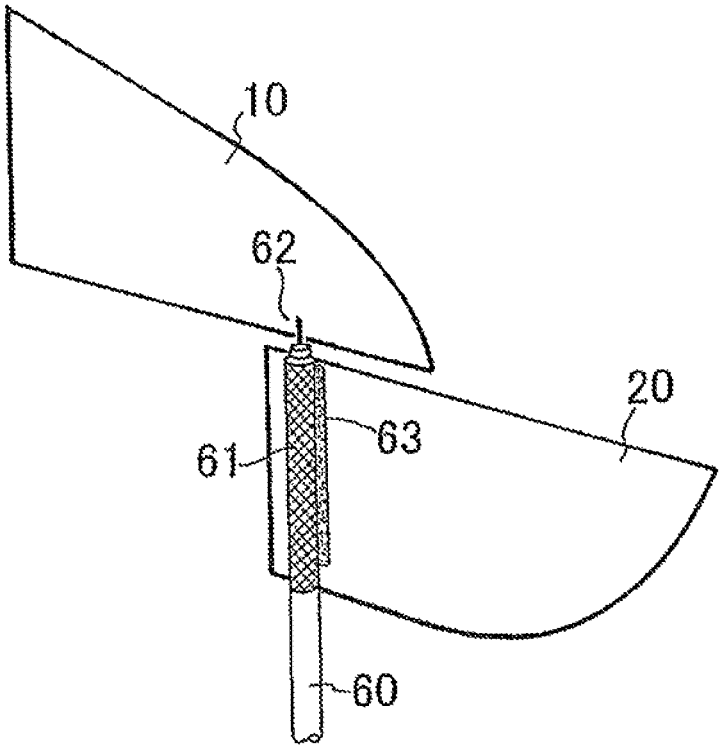
FIG. 11 A perspective view shows the fifth example of the wideband antenna according to the present invention.

FIG. 11 is a perspective view of the fifth example of the wideband antenna according to the present invention. As shown in FIG. 11, the outer coaxial conductor 61 of the coaxial cable 60 is connected to the radiating element 20 by soldering 63.

Sixth Example

Figure 12:
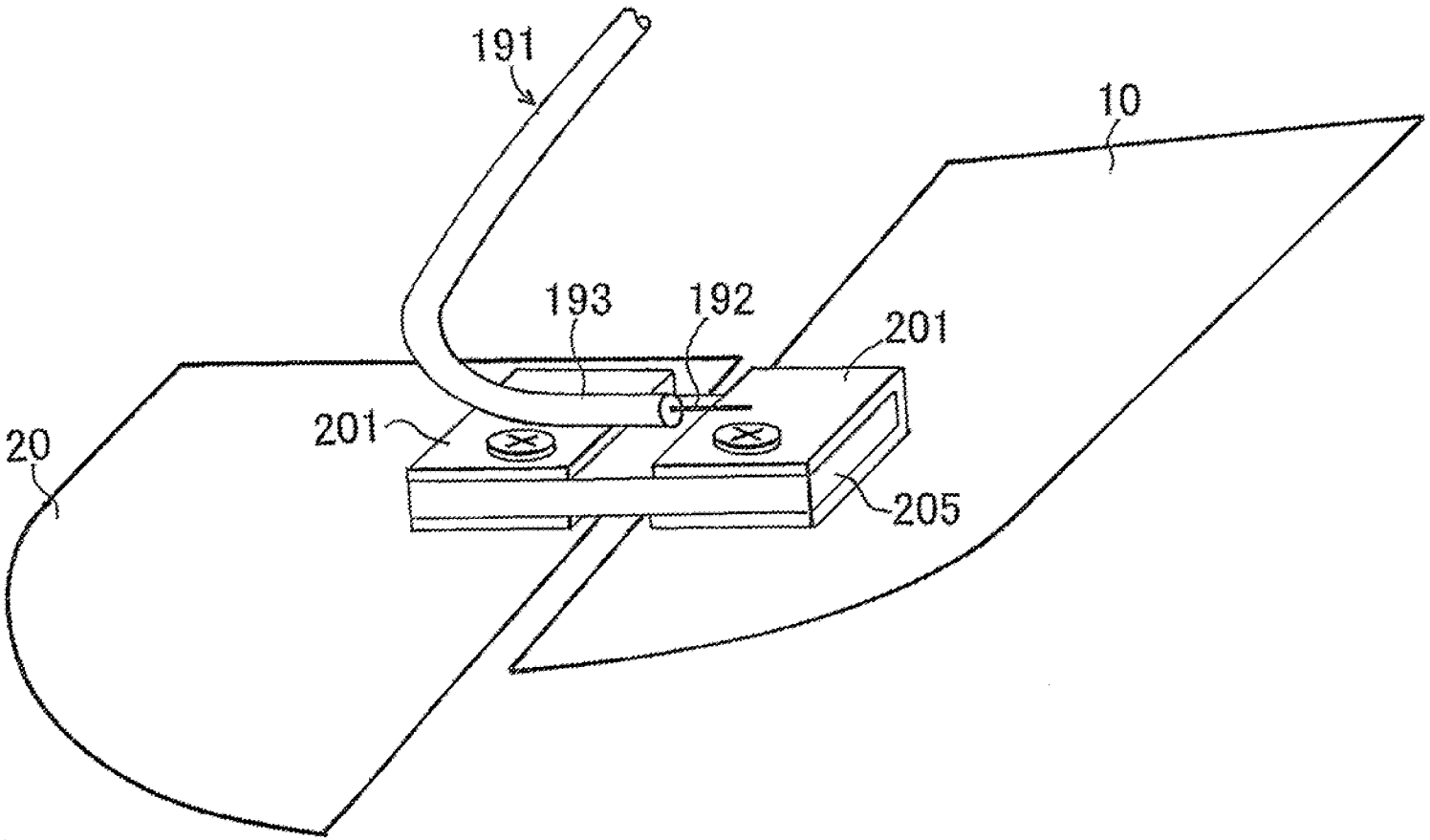
FIG. 12 A configuration diagram shows a sixth example of a wideband antenna according to the present invention.

FIG. 12 is a configuration diagram of a sixth example of a wideband antenna according to the present invention. The present example is an example using, as a feed portion, components including pieces of feed hardware 201 serving as conductor portions, a feed board 205, and a coaxial cable 191. This configuration is particularly effective in the case of radiating elements 10 and 20 formed of an unsolderable material such as conductive fabrics. The feed board 205 is placed to straddle the two radiating elements 10 and 20, and a center coaxial conductor 192 and an outer coaxial conductor 193 of the coaxial cable 191 are respectively connected by soldering to portions of the two pieces of hardware 201 provided on the feed board 205. The connection may use crimping or a conductive adhesive.

Figure 13:
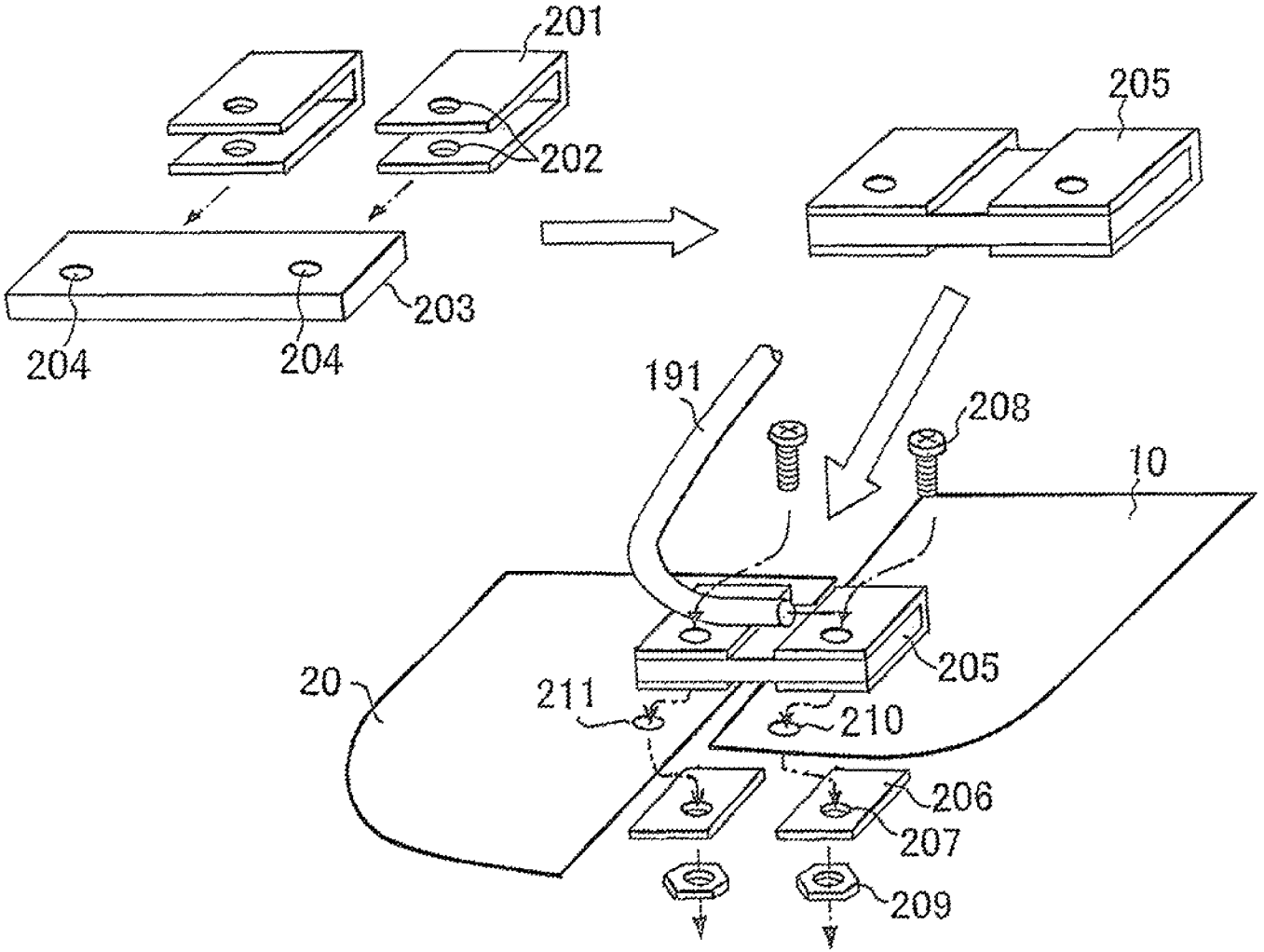
FIG. 13 An assembly diagram shows a feed portion.
Figure 14:
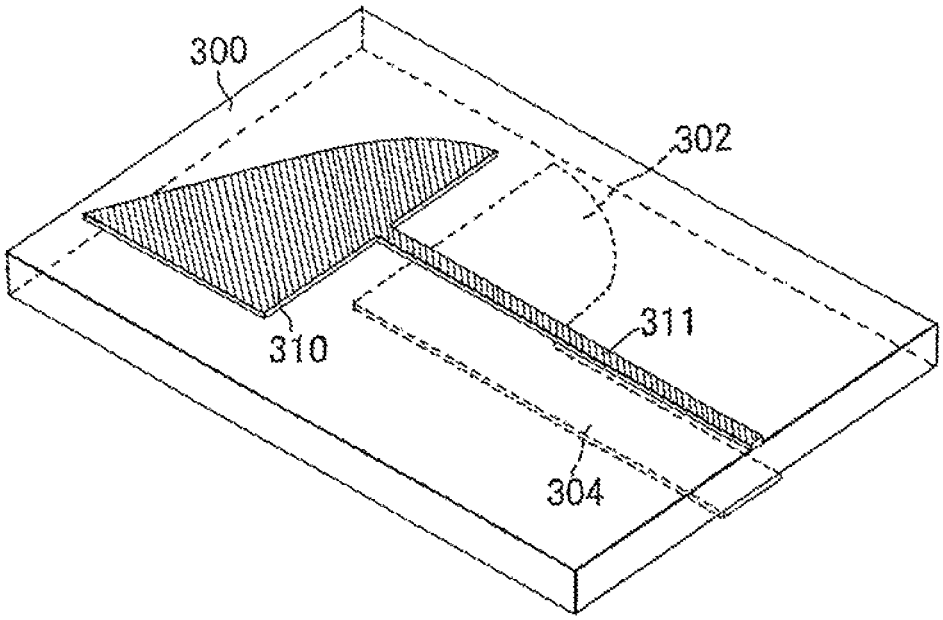
FIG. 14 A configuration diagram shows a seventh example of a wideband antenna according to the present invention.

FIG. 13 is an assembly diagram of the feed portion. The feed board 205 is formed of two pieces of U-shaped hardware 201 made of a conductor or metal; and a support 203 made of a plate-like dielectric. The pieces of hardware 201 are engaged with the support 203 such that two holes 202 made at the same location between the top and bottom portions of each piece of hardware 201 coincide in hole location with a corresponding one of two holes 204 made in the support 203, thereby forming the feed board 205. Then, the feed board 205 is fixed with screws 208 such that the pieces of hardware 201 respectively come into contact with the right and left radiating elements 2. Upon fixing, fixing plates 206 with holes 207 are placed underneath the right and left radiating elements 10 and 20 such that the screws 208 pass through holes 210 and 211 made in the radiating elements 10 and 20, respectively, and the screws 208 are fixed with nuts 209. At this time, the fixing plates 206 can use either a conductor or a dielectric. Then, the center coaxial conductor 192 and the outer coaxial conductor 193 of the coaxial cable 191 are respectively connected by soldering, etc., to portions of the two pieces of hardware 201 provided on the feed board 205. Note that a feeder connected to the portions of the two pieces of hardware 201 provided on the feed board 205 is not limited to a coaxial cable, and a parallel two-wire feeder can also be used.

Seventh Example

FIG. 14 is a configuration diagram of a seventh example of a wideband antenna according to the present invention. This antenna is such that an antenna shown in FIG. 7 is formed using a printed circuit board 300. For the printed circuit board 300, Teflon (registered trademark), an FR-4 material (glass epoxy), BT resin, PPE, a liquid crystal polymer material, etc., are often used. A radiating element 310 is disposed on a top side of the printed circuit board 300 and is fed by a microstrip line 311 from a lower edge thereof. On a bottom side of the printed circuit board 300, a radiating element 302 is disposed and a ground line 304 serving as ground (GND) is disposed as a feed conductor of the microstrip line 311. The ground line 304 together with the microstrip line 311 forms a microstrip transmission line. By the microstrip transmission line, the radiating elements 310 and 302 are fed.

Although the above-described fifth, sixth, and seventh examples take up, as an example, a wideband antenna of the configuration shown in FIG. 7, wideband antennas in FIGS. 6, 8, and 9 can, of course, be used.

Figure 15:
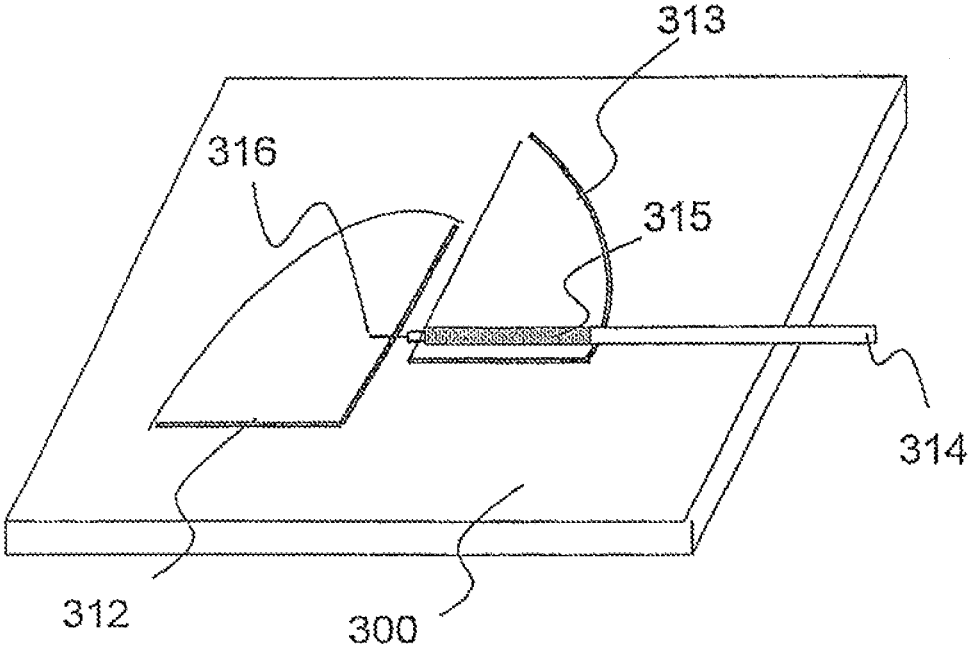
FIG. 15 A configuration diagram shows another configuration of the seventh example of the wideband antenna according to the present invention.

In addition, although, in the configuration using a printed circuit board shown in FIG. 14, the radiating elements 310 and 302 are formed using both sides of the printed circuit board 300, there is also a configuration method in which, as shown in FIG. 15, two radiating elements 312 and 313 are formed on one side of a printed circuit board 300 and a coaxial cable 314 is soldered thereto. A center coaxial conductor 316 and an outer coaxial conductor 315 of the coaxial cable 314 are respectively connected by soldering, etc., to the radiating elements 312 and 313.

Eighth Example

Figure 16:
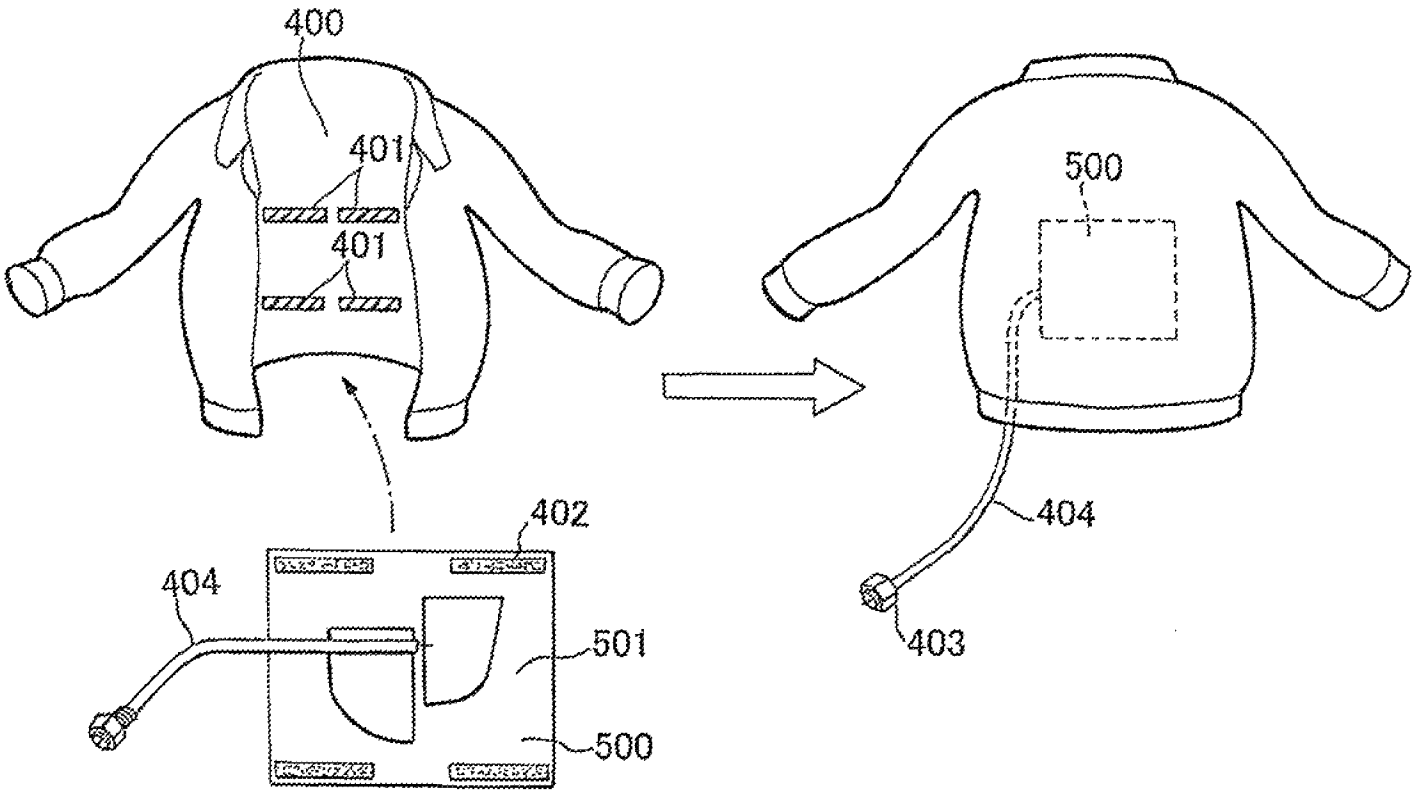
FIG. 16 A configuration diagram shows an eighth example showing wear using a wideband antenna according to the present invention.

FIG. 16 is a configuration diagram of an eighth example showing wear using a wideband antenna according to the present invention. An antenna 500 is configured to be attached to a wear 400 such as a blazer or a jacket, using magic tapes (registered trademark) 401. A base 501 having the antenna 500 attached thereto is formed of a soft material such as an insulator fabric. Magic tapes 402 are added to an edge so as to be attached to the magic tapes 401 on the side of the wear 400. This structure provides easy removal. A connector 403 is connected to an end of a coaxial cable 404 and the antenna 500 is connected to a required device through the connector 403.

Note that in FIG. 16 magic tapes are an example of fixation; in addition thereto, there are fixing methods using buttons, snap buttons, zippers, hooks, adhesives, etc.

Ninth Example

Figure 17:
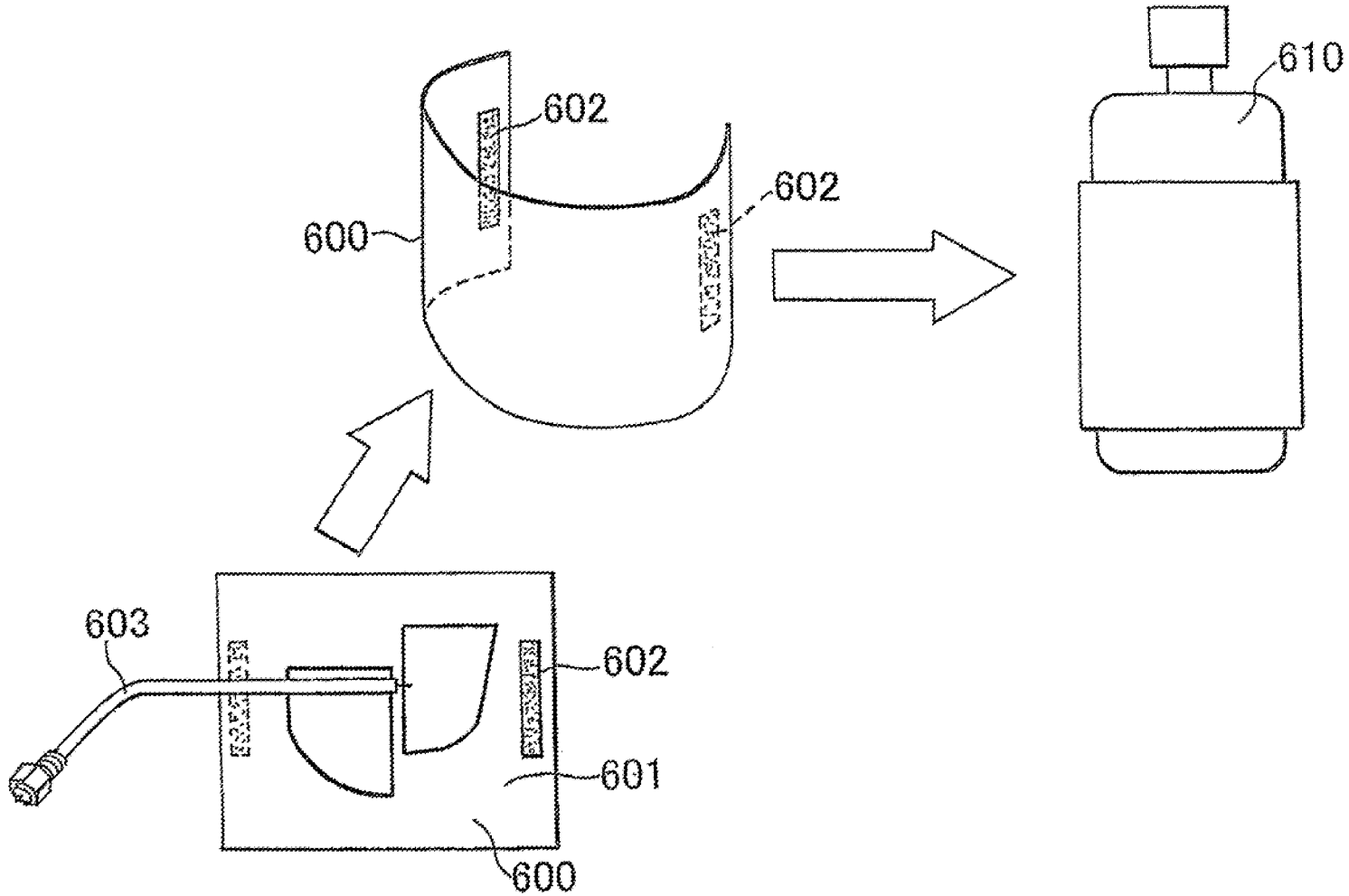
FIG. 17 A configuration diagram shows a ninth example of a wideband antenna according to the present invention.

FIG. 17 is a configuration diagram of a ninth example of a wideband antenna according to the present invention. An antenna 600 is configured to be attached around a plastic bottle 610. A base 601 of the antenna 600 is formed of a soft material such as an insulator fabric. Magic tapes 602 are added to both ends. The antenna 600 is structured to be wrapped around the plastic bottle 610 and fastened with the magic tapes.

Note that in FIG. 17 magic tapes are an example of fixation; in addition thereto, there are fixing methods using buttons, snap buttons, zippers, hooks, rubber bands, adhesives, etc. Note also that a method in which strings are sewed on the ends of the base 601 and the antenna 600 is fixed by tying the strings together is also effective.

Drinking water in plastic bottles can be easily bought from vending machines and is widely drunk. This type of drink is put on a table in an office, etc., and drunk. Forming the antenna 600 using a conductive fabric allows a user to easily wrap the antenna 600 around the plastic bottle and fix it. Thus, this antenna is convenient because:

1) The antenna can be fixed to a regularly used plastic bottle.

2) An adjustment to direction is easy.

3) The antenna can be used regardless of the amount of drink in the plastic bottle or of whether there is drink in the plastic bottle.

4) The antenna can be removed and put away in a bag when not necessary.

There are such four advantages.

In particular, the advantage 3) makes use of a feature that the antenna can be used even if the antenna is present near a dielectric.

Tenth Example

Figure 18:
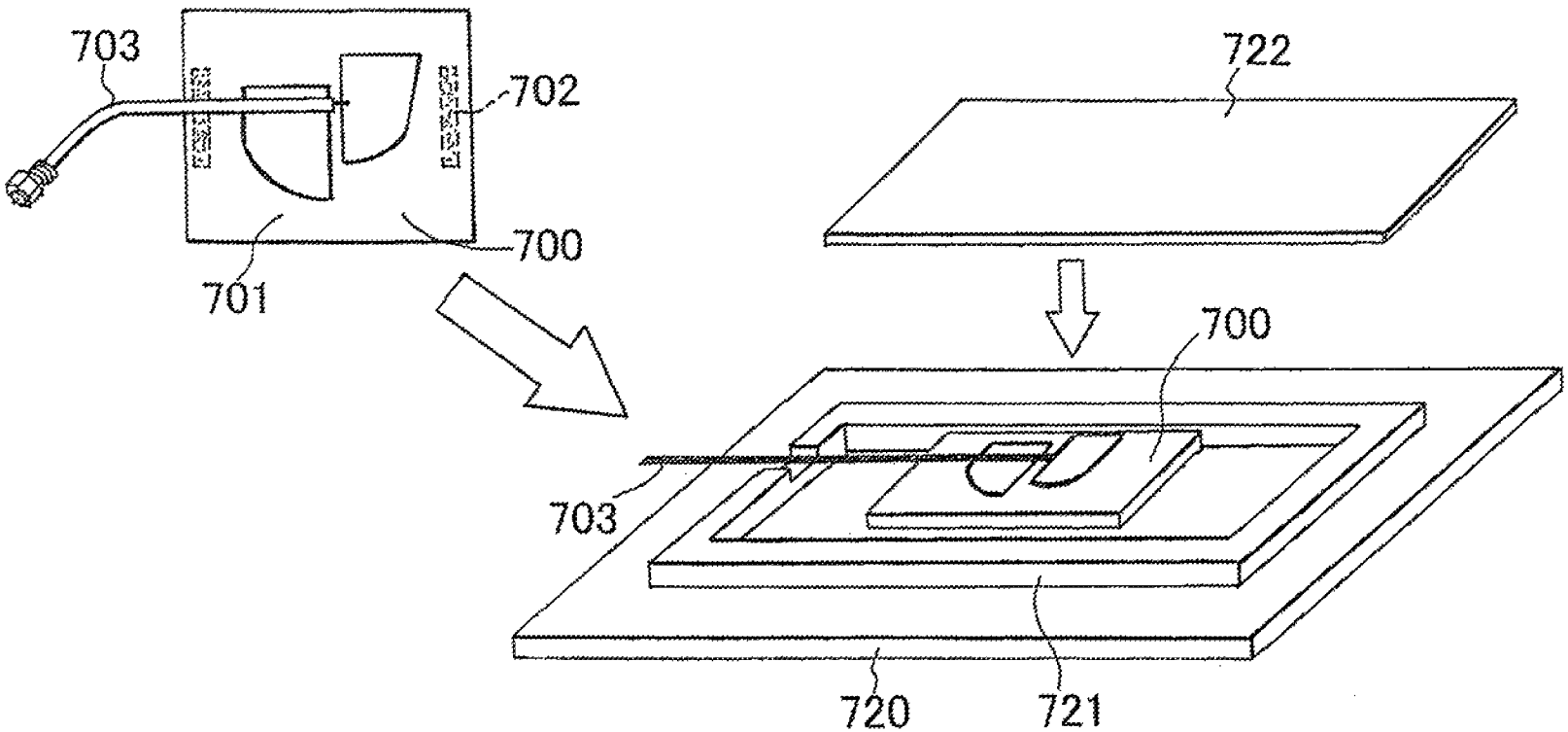
FIG. 18 A configuration diagram shows a tenth example showing a frame using a wideband antenna according to the present invention.

FIG. 18 is a configuration diagram of a tenth example showing a frame using a wideband antenna according to the present invention. This is an example of attaching an antenna to the back of a frame. This antenna 700 is formed by etching a printed circuit board such as that shown in FIG. 14, and is formed of a printed circuit board 701, a coaxial cable 703 having, at its end, a connection means such as a coaxial connector, and double stick tapes 702 for fixation (disposed on the back side of the printed circuit board). The antenna 700 is adhered to the back side of a frame 720. Then, the antenna 700 is protected by a wall surface 721 and a cover 722. By thus attaching the frame onto the wall surface with the antenna being contained on the back, while it appears to be a painting, the antenna is disposed on the back side and thus it can be used as an antenna.

Note that in the above description, in addition to a frame, the antenna can be mounted by the same method on a wall clock, a bulletin board, a blackboard, a whiteboard, an office partition, the back side of a storage door, etc.

In FIG. 18, when attaching the antenna 700 to the back side of the frame, if it is difficult to directly attach the antenna 700 to the back of the frame or if the user hesitates to do so, the wall surface 721 may be formed to be a box-like structure having a bottom side so that the antenna 700 can be contained in the box.

The antenna 700 in FIG. 18 does not particularly need to use a printed circuit board and may be formed of a conductive fabric or an FPC.

Also, the method of attaching the antenna 700 is not limited to one using double stick tapes, and common fixing methods using adhesives, screws, magic tapes, engagement structures, snap buttons, buttons, zippers, hooks, etc., can be used. For these fixing methods, an appropriate method is appropriately selected according to the type of configuration of the antenna 700 (whether it uses a printed circuit board, an FPC, or a conductive fabric).

For fixation of the cover 722 to the wall surface 721, too, there are methods using double stick tapes, screw fastening, adhesives, engagement, snap buttons, hooks, etc.

When an antenna is formed using a printed circuit board, its configuration is simple and allows slimming down, and thus, the antenna can be placed on the back side of a frame. By placing the frame with the antenna placed thereon on a wall surface, it appears to be a painting, etc., but the antenna is placed on the back. Accordingly, without revealing the presence of the antenna, the frame can be allowed to function as an antenna. This type of attachment mode is effective in not deteriorating the atmosphere of rooms in hotels, public floors, restaurants, etc.

The configuration in FIG. 18 provides the convenience of handling in terms of that the antenna itself can be separated from the painting by forming the wall surface 721 to be a structure having the bottom such as a box, and fastening the cover 722 with screws or magic tapes.

Note that when the wall surface on which the antenna is mounted is a metal (conductor), a radio wave absorber is added onto a surface of the cover 722 on the antenna side or a surface of the cover 722 on the wall side. By this, the influence of the metal of the wall surface can be eliminated.

Although the above-described eighth, ninth, and tenth examples use, as an antenna, a wideband antenna of the configuration shown in FIG. 7, wideband antennas in FIGS. 6, 8, and 9 can, of course, be used.

Wideband antennas according to the present invention and use examples in which wear, frames, etc., use the wideband antennas are described above. The characteristics of the wideband antennas according to the present invention will be described below.

Figure 19:
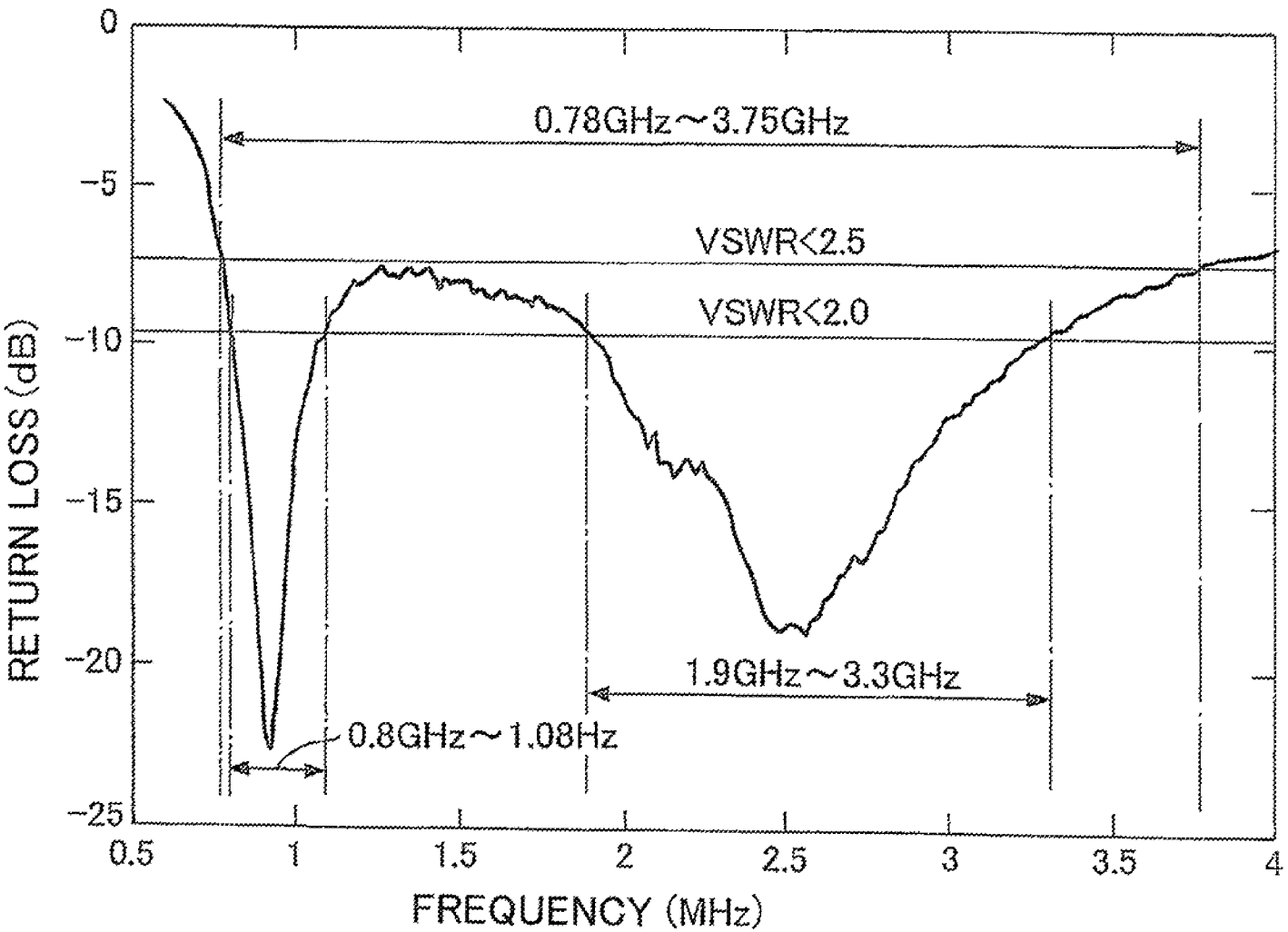
FIG. 19 A diagram shows the return loss characteristics of a wideband antenna according to the present invention.

FIG. 19 shows results obtained by actually measuring return loss characteristics of a wideband antenna according to the present invention which is experimentally produced. The experimentally produced wideband antenna is a wideband antenna of the configuration shown in FIG. 6.

The dimensions of each component in FIG. 6 for when converted at the center frequency of a low frequency band roughly have values shown below.

In a radiating element 10, the length A1 is a 0.23 wavelength, the length B1 is a 0.16 wavelength, the length C1 is a 0.13 wavelength, and the length D1 is a 0.03 wavelength. In a radiating element 20, the length A2 is a 0.25 wavelength, the length B2 is a 0.15 wavelength, and the length C2 is a 0.02 wavelength. The positional relationship between a feed point and the radiating elements 10 and 20 is such that the length E1 is a 0.16 wavelength and the length E2 is a 0.01 wavelength. The spacing F between a straight line portion 11 and a straight line portion 21 is a 0.006 wavelength and the length G between a straight line portion 12 and a straight line portion 22 is a 0.15 wavelength. A feed scheme is one in which feeding is performed using the configuration shown in FIGS. 12 and 13.

In the return loss characteristics (actual measured values) in FIG. 19, the horizontal axis represents frequency and the vertical axis represents return loss. The return losses corresponding to VSWRs (Voltage standing wave ratios) of 2.0 and 2.5 are −9.5 dB and −7.4 dB, respectively.

First, taking a look at VSWR<2.0, i.e., a return loss of −9.5 dB, it can be seen that two bands are covered.

In a low frequency band, 0.8 GHz to 1.08 GHz are covered and a fractional bandwidth of 29.8% is obtained. In a high frequency band, 1.9 GHz to 3.3 GHz are covered and a fractional bandwidth of 53.8% is obtained.

Of special note is that the fractional bandwidth of frequencies ranging from a lowest frequency used in the low frequency band of 0.8 GHz to a highest frequency used in the high frequency band of 3.3 GHz is 122%.

Furthermore, considering VSWR<2.5, i.e., a return loss of −7.4 dB, 0.78 GHz to 3.75 GHz are covered and a fractional bandwidth of 131.1% is obtained.

The above-described wideband antennas of the embodiment and the examples have the following effects:

1) The antennas are planar and thin.

2) For electrical characteristics, two bands can be covered and in a high frequency band, wideband characteristics can be obtained.

3) In addition to a configuration using a conductive plate, configurations using a bendable conductive film and a fabric with conductivity can be employed.

4) When an antenna is formed of a fabric with conductivity, the antenna can be implemented by a configuration where a coaxial cable does not need to be soldered to the fabric.

5) The antennas are mountable on clothing, etc.

6) Even if the antennas are mounted in proximity to a human body, the input impedance characteristics do not deteriorate. Specifically, even if the antennas are attached to clothing and used by a user wearing the clothing, the input impedance characteristics do not deteriorate and wideband characteristics can be maintained.

When the wideband antennas of the examples are used, if, for example, the low frequency band is designed to provide 800 MHz band cellular phones, then the high frequency band can cover 1.9 GHz to 3.3 GHz. In Japan, in the band of 1.9 GHz to 3.3 GHz, there are a band used by 2 GHz band cellular phones (1.92 GHz to 2.2 GHz), a band used by wireless LANs (2.4 GHz to 2.5 GHz), and WiMAX (2.5 GHz to 2.6 GHz). Antennas that can be used in any of those radio systems can be implemented. Recently, there has been a demand for terminals capable of supporting a plurality of radio systems, and the antennas can support these applications.

Furthermore, in recent years, there has been considered a cognitive radio system that uses a plurality of radio systems by appropriately selecting or switching them when necessary. The antennas are also applicable to applications of these systems.

Furthermore, a great feature of the antennas is that, in addition to a configuration using a conductive plate, configurations using a bendable conductive film and a fabric with conductivity can be employed. In particular, when an antenna is formed of a fabric with conductivity, it is difficult to secure electrical connection by a method such as soldering, etc., of a coaxial cable to the fabric with conductivity. However, the antenna can be implemented by a configuration where a coaxial cable does not need to be directly soldered to the fabric.

In addition, since a configuration using a conductive fabric can be employed, an antenna can be sewed on clothing, etc., or attached using adhesive tapes, magic tapes, buttons, snap buttons, hooks, zippers, etc.

When an antenna is attached to clothing and used, the antenna and a human body's body are, of course, brought into close contact with each other. However, even in such a case, the antenna can be used without the input impedance of the antenna itself changing and without the matching state deteriorating. Note that normally when a human body is present near an antenna, the input impedance greatly changes and thus the matching state greatly deteriorates.

The antennas can be said to be effective antennas as so-called "wearable antennas" that can be used integrally with clothing being in close contact with a human body in the above-described manner.

Although the eighth example describes an example of attaching a wideband antenna of the present embodiment to wear such as blazers and jackets, the antenna may be attached to coats, skirts, pants, scarves, hats, etc., which are also included in the wear. In addition, the antenna may be attached not only to those put on a human body but also to belongings such as bags, knapsacks, soft cases for personal computers, etc., and accessory cases. As used herein, the belongings refer to articles that can be carried in the hand, hung on the shoulder, or carried on the shoulder. The wideband antenna can be attached to the outside or inside of belongings such as wear and bags. In addition, the wideband antenna can be attached as a side pocket of a bag. The attachment can be performed using magic tapes, buttons, snap buttons, hooks, zippers, etc. The base to which the wideband antenna is attached can also be directly put in a bag, etc., as a sheet-like antenna.

Although the tenth example takes up an example of a frame, the wideband antenna can also be used in wall mount products such as wall clocks and bulletin boards, including frames, office supplies such as blackboards, whiteboards, and office partitions, storage doors, etc. Wall mount products such as frames, wall clocks, and bulletin boards, office supplies such as blackboards, whiteboards, and office partitions, and storage doors are in the form of plates, and by installing or adhering wideband antennas therein/thereto, plate-like objects having the wideband antennas attached thereto can be formed.

Although the representative embodiment and examples of the present invention have been described above, the present invention can be implemented in other various forms without departing from the spirit or essential characteristics thereof defined by the appended claims. Therefore, each of the above-described embodiments is merely illustrative and should not to be construed to be in a limiting sense. The scope of the present invention is indicated by the claims and thus is not limited to the description made in the specification or abstract. Furthermore, all modifications and changes which come within the range of equivalency of the claims are intended to be embraced in the scope of the present invention.

INDUSTRIAL APPLICABILITY

The present invention can be used in antennas for receiving digital terrestrial broadcasting, antennas for communications such as cellular phones, wireless LANs, and WiMAX, and antennas for cognitive radio and software radio.

(Supplementary Note 1)

A wideband antenna comprising: a first plate-like radiating element including at least a first side and a second side, the first side being a straight line portion and the second side being curved; and a second plate-like radiating element including at least a third side and a fourth side, the third side being a straight line portion and the fourth side being curved, wherein the first side of the first radiating element and the third side of the second radiating element are disposed to face each other in parallel and to be shifted from each other in a parallel direction.

(Supplementary Note 2)

The wideband antenna according to supplementary note 1, wherein each of the second side and the fourth side includes a curve portion.

(Supplementary Note 3)

The wideband antenna according to supplementary note 2, wherein a length of the curve portion of the second side differs from a length of the curve portion of the fourth side.

(Supplementary Note 4)

The wideband antenna according to supplementary note 2, wherein a radius of curvature of the curve portion of the second side differs from a radius of curvature of the curve portion of the fourth side.

(Supplementary Note 5)

The wideband antenna according to supplementary note 1, wherein the second side or the fourth side, or the second and fourth sides is(are) formed by a combination of one or a plurality of curve portions and one or a plurality of straight line portions.

(Supplementary Note 6)

The wideband antenna according to supplementary note 1, wherein the second side or the fourth side, or the second and fourth sides is(are) formed by a combination of a plurality of straight line portions, and an angle formed only by adjacent straight line portions is an obtuse angle as viewed from an inside of sides of the first or second radiating element or the first and second radiating elements.

(Supplementary Note 7)

The wideband antenna according to any one of supplementary notes 1 to 6, wherein a shape of the first radiating element is different from that of the second radiating element.

(Supplementary Note 8)

The wideband antenna according to any one of supplementary notes 1 to 4, wherein the first radiating element includes a fifth side connecting to the first side, and the second radiating element has a sixth side connecting to the third side, the fifth side and the sixth side being straight line portions.

(Supplementary Note 9)

The wideband antenna described in the supplementary note 8, wherein the fifth side and the sixth side are disposed at substantially right angles to the first and third sides, respectively.

(Supplementary Note 10)

The wideband antenna described in the supplementary note 8, wherein the fifth side forms an obtuse angle with the first side, and the sixth side forms an obtuse angle with the third side.

(Supplementary Note 11)

The wideband antenna according to any one of supplementary notes 1 to 10, wherein the first and second radiating elements are made of materials bendable and having conductivity.

(Supplementary Note 12)

The wideband antenna according to any one of supplementary notes 1 to 10, wherein the first and second radiating elements are made of fabrics with conductivity.

(Supplementary Note 13)

The wideband antenna according to any one of supplementary notes 1 to 12, wherein the first and second radiating elements are fed in a position where a part of the first side and a part of the third side face each other.

(Supplementary Note 14)

The wideband antenna described in the supplementary note 13, wherein the feeding is performed by a coaxial cable, and the first radiating element is connected to a center conductor of the coaxial cable and the second radiating element is connected to an outer conductor of the coaxial cable.

(Supplementary Note 15)

The wideband antenna described in the supplementary note 13, wherein the first and second radiating elements are connected to a coaxial cable through a feed member, and the feed member has a conductive portion and a dielectric, and the coaxial cable is connected to the conductive portion.

(Supplementary Note 16)

The wideband antenna according to any one of supplementary notes 1 to 15, wherein an amount of shift between the first side and the third side is adjusted between 0.1 to 0.2 wavelengths of a lowest useful frequency.

(Supplementary Note 17)

The wideband antenna according to any one of supplementary notes 1 to 10 and 16, wherein the first radiating element is provided on one side of a printed circuit board, and the second radiating element is provided on the other side.

(Supplementary Note 18)

The wideband antenna according to any one of supplementary notes 1 to 10 and 16, wherein the first and second radiating elements are provided on a same side of a printed circuit board.

(Supplementary Note 19)

A wear comprising a wideband antenna according to any one of supplementary notes 1 to 18 attached thereto.

(Supplementary Note 20)

A belonging comprising a wideband antenna according to any one of supplementary notes 1 to 18 attached thereto.

(Supplementary Note 21)

A plate-like object comprising a wideband antenna according to any one of supplementary notes 1 to 18 attached thereto.

REFERENCE SIGNS LIST

1, 2, 3, 4, 10, 20, 30, 40, and 50: RADIATING ELEMENT
1-1, 1-2, 2-1, and 2-2: STRAIGHT LINE PORTION
1-3 and 2-3: CURVE PORTION
11, 12, 13, 21, 22, and 23: STRAIGHT LINE PORTION
14 and 24: CURVE PORTION

The invention claimed is:

1. A wideband antenna comprising: a first plate-like radiating element including at least a first side and a second side, the first side being a straight line portion and the second side being curved; and a second plate-like radiating element including at least a third side and a fourth side, the third side being a straight line portion and the fourth side being curved, wherein the first side of the first radiating element and the third side of the second radiating element are disposed to face each other in parallel and to be shifted from each other in a parallel direction.

2. The wideband antenna according to claim 1, wherein a length of the curve portion of the second side differs from a length of the curve portion of the fourth side.

3. The wideband antenna according to claim 1, wherein a radius of curvature of the curve portion of the second side differs from a radius of curvature of the curve portion of the fourth side.

4. The wideband antenna according to claim 1, wherein the second side or the fourth side, or the second and fourth sides is(are) formed by a combination of one or a plurality of curve portions and one or a plurality of straight line portions.

5. The wideband antenna according to claim 1, wherein the second side or the fourth side, or the second and fourth sides is(are) formed by a combination of a plurality of straight line portions, and an angle formed only by adjacent straight line portions is an obtuse angle as viewed from an inside of sides of a first or second radiating element or first and second radiating elements.

6. The wideband antenna according to claim 1, wherein a shape of the first radiating element is different from that of the second radiating element.

7. The wideband antenna according to claim 1, wherein the first radiating element includes a fifth side connecting to the first side, and the second radiating element has a sixth side connecting to the third side, the fifth side and the sixth side being straight line portions.

8. The wideband antenna according to claim 7, wherein the fifth side and the sixth side are disposed at substantially right angles to the first and third sides, respectively.

9. The wideband antenna according to claim 7, wherein the fifth side forms an obtuse angle with the first side, and the sixth side forms an obtuse angle with the third side.

10. The wideband antenna according claim 1, wherein the first and second radiating elements are made of materials bendable and having conductivity.

11. The wideband antenna according to claim 1, wherein the first and second radiating elements are made of fabrics with conductivity.

12. The wideband antenna according to claim 1, wherein the first and second radiating elements are fed in a position where a part of the first side and a part of the third side face each other.

13. The wideband antenna according to claim 12, wherein the feeding is performed by a coaxial cable, and the first radiating element is connected to a center conductor of the coaxial cable and the second radiating element is connected to an outer conductor of the coaxial cable.

14. The wideband antenna according to claim 12, wherein the first and second radiating elements are connected to a coaxial cable through a feed member, and the feed member has a conductive portion and a dielectric, and the coaxial cable is connected to the conductive portion.

15. The wideband antenna according to claim 1, wherein an amount of shift between the first side and the third side is adjusted between 0.1 to 0.2 wavelengths of a lowest useful frequency.

16. The wideband antenna according to claim 1, wherein the first radiating element is provided on one side of a printed circuit board, and the second radiating element is provided on the other side.

17. The wideband antenna according to claim 1, wherein the first and second radiating elements are provided on a same side of a printed circuit board.

18. A wear comprising a wideband antenna according to claim 1 attached thereto, the wear being one of a blazer, a jacket, a coat, a skirt, pants, a scarft, and a hat.

19. A belonging comprising a wideband antenna according to claim 1 attached thereto, the belonging being one of a bag, a knapsack, a soft case, and an accessory case.

20. A plate-like object comprising a wideband antenna according to claim 1 attached thereto, the plate-like object being one of a frame, a wall clock, a bulletin board, a blackboard, a whiteboard, an office partition, and a storage door.

* * * * *